US006276966B1

(12) United States Patent
Yamoto et al.

(10) Patent No.: US 6,276,966 B1
(45) Date of Patent: Aug. 21, 2001

(54) JACK WITH SHIELD PLATE

(75) Inventors: Tadashi Yamoto; Hiroshi Suzuki; Motokazu Sasa, all of Tokyo (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 09/640,420

(22) Filed: Aug. 17, 2000

(30) Foreign Application Priority Data

Aug. 31, 1999 (JP) ..... 11-245783

(51) Int. Cl.[7] ..... H01R 13/648
(52) U.S. Cl. ..... 439/607
(58) Field of Search ..... 439/607, 63, 581, 439/108, 578, 86, 87, 88

(56) References Cited

U.S. PATENT DOCUMENTS 5,035,652 * 12/1997 Shibano ..... 439/610
5,700,164 * 12/1997 Weidler et al. ..... 439/607
6,077,120 * 6/2000 Futatsugi et al. ..... 439/607
6,109,966 * 8/2000 Chiou ..... 439/607

* cited by examiner

*Primary Examiner*—Tulsidas Patel
(74) *Attorney, Agent, or Firm*—Morrison Law Firm

(57) ABSTRACT

A shield plate inhibits high frequency noise generated by a circuit board from interfering with the operation of a jack connector. The jack and shield are mounted on a circuit board and the shield is connected to the shield plate and a common terminal of the jack. The shield plate is elastic and contains magnetic powder with a high flux density to interrupt high frequency noise coming from a direction of a circuit board. When mounted to a device chassis, the shield is connected to the chassis through resilient arms. The chassis, shield, shield plate and common terminal of the jack are all connected together and to a common ground. This configuration reduces incident noise received by the jack, without the need to modify the jack or circuit to optimize noise resistance.

22 Claims, 5 Drawing Sheets

PRIOR ART

JACK WITH SHIELD PLATE

BACKGROUND OF THE INVENTION

The present invention relates to a jack mounted to various kinds of devices such as an audio device, a video device, etc. In particular, the present invention relates to a jack with a shield plate that improves resistance to electrical noise and interference.

Referring to FIG. 9, a conventional jack 100 with a shield plate 3 and a jack body 2 is shown. Jack body 2 is mounted on a circuit board 4 and has several terminals connected to a circuit pattern on circuit board 4. The terminals are arranged within an insulating housing constructed of synthetic resin formed in a rectangular parallelepiped shape. In FIG. 9, reference numerals 5*a*, 6*a* and 7*a* respectively designate leg portions of a sleeve terminal, a chip terminal and a ring terminal. These leg portions extend through a rear face side of circuit board 4. Leg portion 5*a* is solder-connected to a ground pattern of circuit board 4, which is connected to a circuit board ground. Leg portion 6*a* and leg portion 7*a* are respectively solder-connected to unillustrated signal patterns of circuit board 4, which provides an electrical connection to a predetermined circuit.

Jack body 2 is mounted to a metallic chassis 9 of a device with a cylindrical sleeve 8. Sleeve 8 is located on an insertion side of jack body 2.

Shield plate 3 has a covering portion 10 having a shape for covering front and side faces of jack body 2. Shield plate 3 also has a pressing piece 11 arranged continuously with, and below, covering portion 10. Shield plate 3 is formed from a single conductive metallic plate.

Pressing piece 11 is arm shaped, which permits the capability of a leafspring type response. Pressing piece 11 is integral with, and slanting forward from, a front face of covering portion 10. When sleeve portion 8 of jack body 2 is inserted into metallic chassis 9, pressing piece 11 is pressed against the front face of jack body 2 and resiliently contacts metallic chassis 9. A sleeve contact piece 12 projects vertically downward and is integral with pressing piece 11.

Shield plate 3 is mounted to jack body 2 with sleeve portion 8 inserted into a through hole 10*a* on the front face of covering portion 10. Sleeve contact piece 12 extends along leg portion 5*a* of the sleeve terminal and is solder-connected to a ground pattern on a portion of circuit board 4. Leg portion 5*a* of the sleeve terminal is also solder-connected to the ground pattern so that sleeve contact piece 12 and leg portion 5*a* are connected to ground.

Accordingly, metallic chassis 9, shield plate 3 and the sleeve terminal are electrically connected to the ground pattern and have a ground electric potential. Furthermore, the front face and both the side faces of jack body 2 are covered by shield plate 3. The terminals within jack body 2 are shielded from external interference from electrical noise, while reducing noise radiation from the device.

With this conventional structure, the jack is shielded from interfering noise on the front face and the left-hand and right-hand side faces of the jack body 2, but is not shielded on a surface facing circuit board 4. Accordingly, a high frequency signal is transmitted through the insulating housing of the jack and circuit board 4. Jack body 2 is thus exposed to high frequency noise entering through the terminals on jack body 2, which causes a mutual interference with other circuit parts mounted on circuit board 4.

Conventional means for limiting the effects of interfering noise involve temporarily mounting jack body 2 on circuit board 4 and injecting high frequency noise through the terminals connected to jack body 2 from a noise generating source. The noise received by other noise-susceptible devices on circuit board 4 is then measured. Based on the measurements, techniques for reducing the effect of noise on the circuit configuration are taken, such as a recombination of circuits, etc. These steps taken to reduce the impact of noise contribute to increasing the complexity and length of time involved in completing production of a device.

OBJECTS AND SUMMARY OF THE INVENTION

In view of the above drawbacks in the prior art, it is an object of the present invention to provide a jack with a shield plate that overcomes the drawbacks of conventional arrangements. It is a further object of the present invention to provide an easily manufactured jack with a shield plate capable of providing excellent shield characteristics. It is yet another object of the present invention to provide a jack with a shield plate that can be produced without the need to measure and compensate for noise effects.

Briefly stated, the present invention provides a shield plate that inhibits high frequency noise generated by a circuit board from interfering with the operation of a jack connector. The jack and shield are mounted on a circuit board and the shield is connected to the shield plate and a common terminal of the jack. The shield plate is elastic and contains magnetic powder with a high flux density to interrupt high frequency noise coming from a direction of a circuit board.

When mounted to a device chassis, the shield is connected to the chassis through resilient arms. The chassis, shield, shield plate and common terminal of the jack are all connected together and to a common ground. This configuration reduces incident noise received by the jack, without the need to modify the jack or circuit to optimize noise resistance.

To achieve the above stated objects of the present invention, a jack with a jack body and shield plate is provided, in which a sleeve terminal in the jack body is connected to a ground pattern of a printed wiring board and at least one signal terminal in the jack body is connected to a signal pattern of the printed wiring board. The sleeve terminal and the signal terminal are insulated from each other, with a noise absorbing elastic shield plate connected to the sleeve terminal. The shield plate is attached to an outer side of the jack body and covers at least left-hand and right-hand side faces of this jack body. The noise absorbing shield plate is attached to a lower surface of the jack body, interposed between the jack body and the printed wiring board.

The noise absorbing shield plate has a terminal insertion hole for receiving the sleeve terminal in a press fit contact, and a notch for receiving the signal terminal without contact. The signal terminal is thus insulated from the noise absorbing shield plate.

The shield plate prevents passage of noises on at least the left-hand and right-hand side faces of the jack body. The elastic shield plate is inserted between the jack body and the printed wiring board and is electrically connected to the ground pattern through the sleeve terminal, which contacts the elastic shield plate in a press fit connection. Accordingly, noise from the printed wiring board are interrupted and prevented from adversely affecting the operation of the jack. The signal terminal of the jack body has no contact with the elastic shield plate, and is insulated when inserted into the elastic shield plate notch. The signal terminal is connected to the signal pattern of the printed wiring board without being short-circuited to the elastic shield plate.

The shield plate has a sleeve contact piece elastically contacting the sleeve terminal for the ground connection. This sleeve contact piece is inserted into the terminal insertion hole of the noise absorbing elastic shield plate in a press fit contact, together with the sleeve terminal. The sleeve terminal and the sleeve contact piece contact each other in the terminal insertion hole of the elastic shield plate and are thus electrically connected to each other. Accordingly, elastic shield plate, the shield plate and the sleeve terminal can be connected to a common ground and held at the same electric potential. The generation of noises can be more reliably prevented while maintaining or reducing the number of solder connections to the ground pattern.

Engaging grooves capable of engaging the noise absorbing elastic shield plate is formed on a side of the jack body facing the printed wiring board. The elastic shield plate can be attached to the jack body by simply engaging elastic shield plate with the engaging grooves. This simple attachment method permits easy attachment, and also permits the elastic shield plate to be easily detached.

According to an embodiment of the present invention, there is provided a jack with a shield plate mountable to a printed wiring board, comprising: a jack body having a sleeve, a sleeve terminal in the sleeve connectable to a ground pattern of the printed wiring board, at least one signal terminal connectable to a signal trace of the printed wiring board, a first shield plate attached to the jack body, the first shield plate covers a portion of the jack body not opposed to the printed wiring board, a second shield plate attached to the jack body, the second shield plate being interposed between the jack body and the printed wiring board, the second shield plate having a sleeve terminal opening and a signal terminal opening, and the sleeve terminal urged into contact with the sleeve terminal opening when the sleeve terminal is inserted thereinto, and an insulative clearance between the at least one signal terminal and the signal terminal opening when the at least one signal terminal is inserted thereinto.

According to another embodiment of the present invention, there is provided a shielded jack mountable on a circuit board, comprising: a jack body with an inner chamber, a shield on the jack body, a noise absorbent shield plate positionable adjacent the circuit board, a common terminal accessible to the inner chamber, the shield connectable to the shield plate and the common terminal, and a ground circuit on the circuit board connectable to the common terminal.

According to still another embodiment of the present invention, there is provided a terminal connector mountable on a circuit board, comprising: a housing with an inner chamber, a shield on the housing, a noise absorbent shield plate interposed between the housing and the circuit board, first and second terminals accessible to the inner chamber, and the shield connected to the shield plate and at least one of the first and second terminals.

According to yet another embodiment of the present invention, there is provided a shielded jack for use with a wiring board, comprising: a housing with an inner chamber, at least a first terminal communicating with the inner chamber and an exterior of the housing, first and second shield plates, the first shield plate positionable adjacent a portion of the exterior of the housing not exposed to the wiring board, the second shield plate interposeable between the housing and the wiring board, the second shield plate being composed of a material having a magnetic powder dispersed therein, and the first and second shield plates and the at least first terminal being electrically connected and being connectable to a ground trace on the wiring board.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
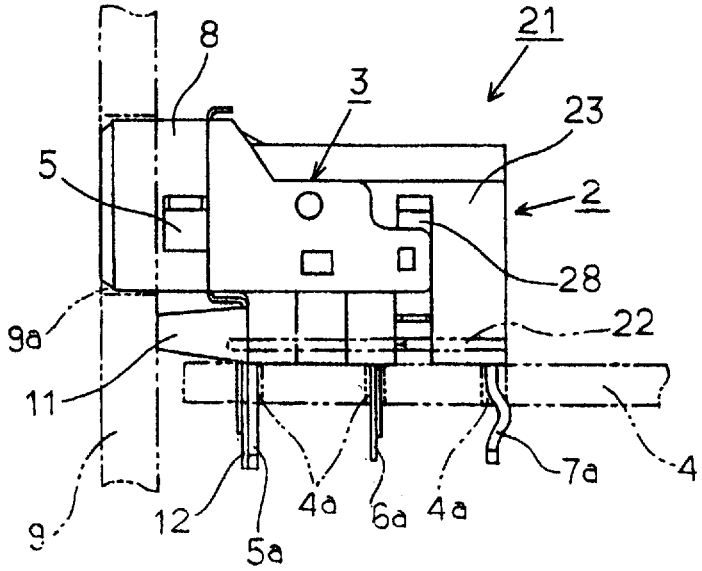
FIG. 1 is a side view showing an assembly state of a jack with a shield plate in one embodiment mode of the present invention.

Referring to FIG. 1, a jack 21 with a shield plate in an embodiment of the present invention is shown. Jack 21 has a jack body 2, a shield plate 3 and an elastic shield plate 22. Jack body 2, shield plate 3 and elastic shield plate 22 are assembled to form jack 21, which is mounted to a circuit board 4 in a complete assembly.

Figure 5:
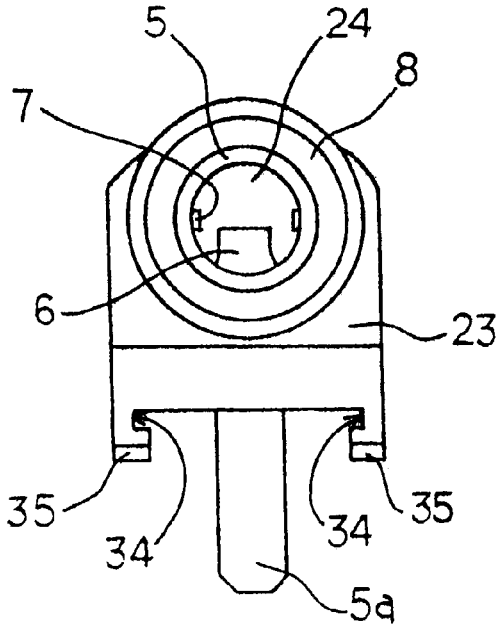
FIG. 5 is a front view of the jack body.

Referring now to FIG. 5, jack body 2 is shown. A cylindrical sleeve 8 and a body portion 23 are integrally formed in jack body 2. Body portion 23 has a rectangular parallelepiped shape. Cylindrical sleeve 8 and body portion 23 are molded with an insulating synthetic resin. A plug insertion hole 24 is formed in jack body 2, communicating between sleeve 8 and body portion 23. Plug insertion hole 24 is adapted to receive an unillustrated plug of a partner device.

A sleeve terminal 5 is arranged in cylindrical sleeve 8. A chip terminal 6 and a ring terminal 7 are arranged within body portion 23. Chip terminal 6 and ring terminal 7 are accessible to plug insertion hole 24. Sleeve terminal 5, chip terminal 6 and ring terminal 7 respectively come in contact with an earth electrode, a chip electrode and a ring electrode of the plug inserted into plug insertion hole 24 in cylindrical sleeve 8. Sleeve terminal 5, chip terminal 6 and ring terminal 7 all make electrical connections to the respective electrodes when contact is made.

Referring again to FIG. 1, terminals 5, 6 and 7 respectively have leg portions 5*a*, 6*a* and 7*a* which project below body portion 23. Leg portions 5*a*, 6*a* and 7*a* each extend through a cooperating through hole 4*a* of circuit board 4. Leg portions 5*a*, 6*a* and 7*a* are then connected by soldering to respective unillustrated circuit patterns on circuit board 4. Specifically, leg portion 5*a* of sleeve terminal 5 is solder-connected to a ground pattern, and leg portion 6*a* of chip terminal 6 and leg portion 7*a* of ring terminal 7 are each solder-connected to respective signal patterns.

Figure 7:
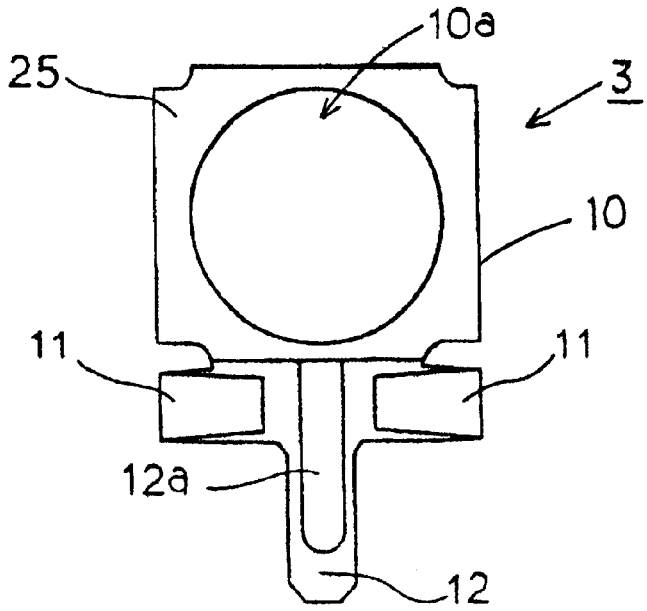
FIG. 7 is a front view of the shield plate.
Figure 8:
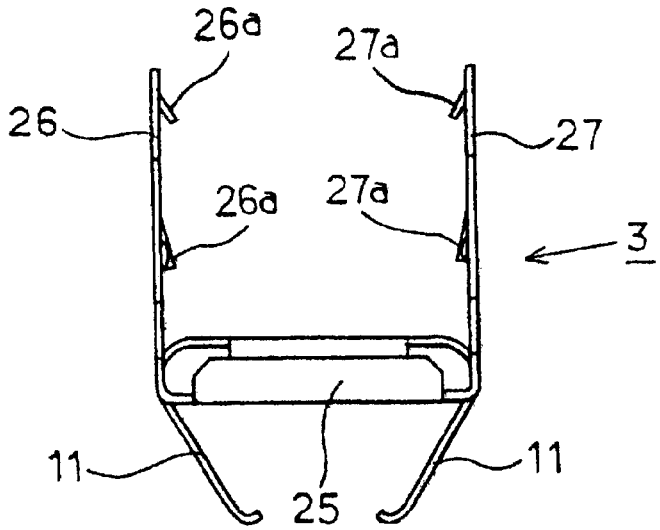
FIG. 8 is a plan view of the shield plate.
Figure 9:
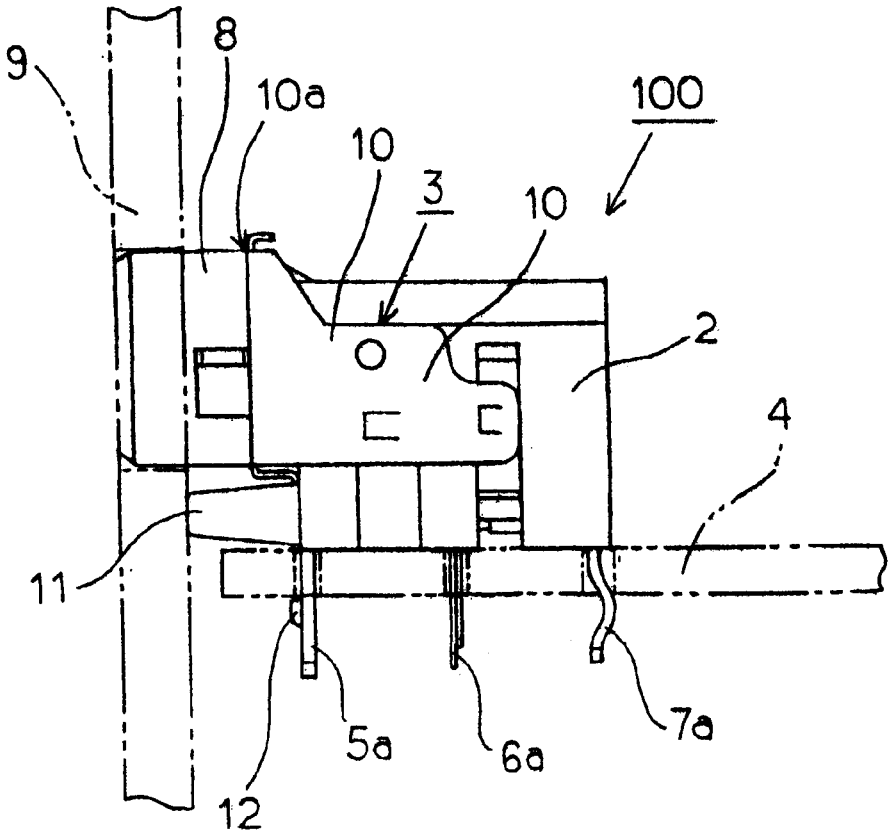
FIG. 9 is a side view of a conventional jack with a shield.

Referring now to FIGS. 7 and 8, shield plate 3 has a covering portion 10, a pair of pressing pieces 11 and a sleeve contact piece 12. Covering portion 10 is constructed with a front plate portion 25 and left-hand and right-hand side plate portions 26 and 27, respectively. Pressing pieces 11 are arranged below and integral with front plate portion 25. Sleeve contact piece 12 is vertically arranged from a portion of shield plate 3 between pressing pieces 11. Covering portion 10, pressing pieces 11 and sleeve contact piece 12 are all integrally formed to provide a conductive metallic plate.

Figure 2:
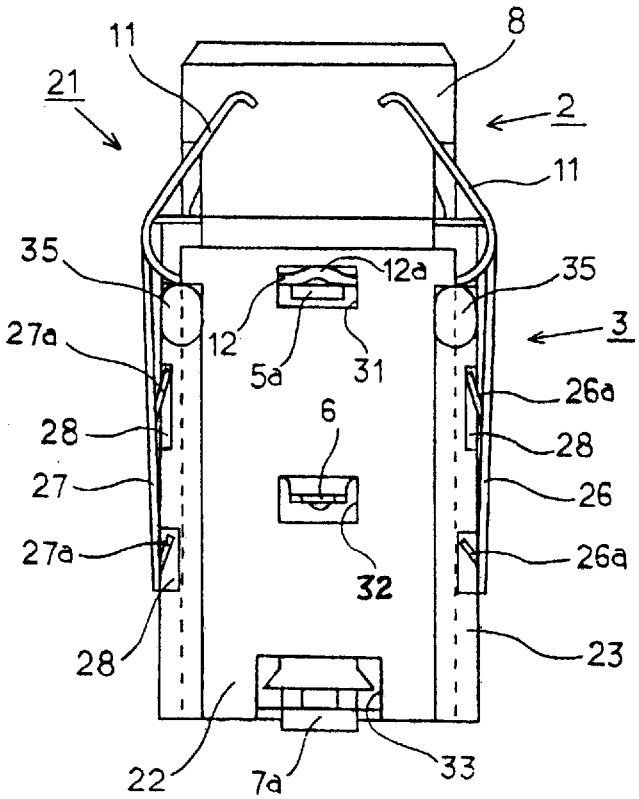
FIG. 2 is a bottom view of the assembly state.

Covering portion 10 of shield plate 3 covers a front face and left-hand and right-hand side faces of jack body 2. Front plate portion 25 covers a front face of body portion 23 of jack body 2, and side plate portions 26 and 27 cover left-hand and right-hand side faces of body portion 23. Shield plate 3 thus covers and shields the front face and the left-hand and right-hand side faces of jack body 2. A through hole 10*a* is formed in front plate portion 25. Sleeve 8 of jack body 2 extends into and beyond through hole 10*a*. Engaging claws 26*a* and 27*a* are respectively cut and protrude inwardly from inner faces of side plate portions 26 and 27. Referring momentarily to FIG. 2, engaging claws 26*a* and 27*a* cooperate with engaging grooves 28 formed on left-hand and right-hand side faces of jack body 2. When shield plate 3 and jack body 2 are assembled, engaging claws 26*a* and 27*a* cooperate with engaging grooves 28 to attach and mount shield plate 3 to jack body 2.

Referring now to FIGS. 7 and 8, pressing pieces 11 are curved and slant in a forward direction on both sides of sleeve contact piece 12 below front plate portion 25. The slant and curvature of pressing pieces 11 permits elastic deformation in a front to rear direction. Referring momentarily to FIG. 1, pressing pieces 11 resiliently contact metallic chassis 9 when jack 21 is arranged within the body of the device.

Figure 3:
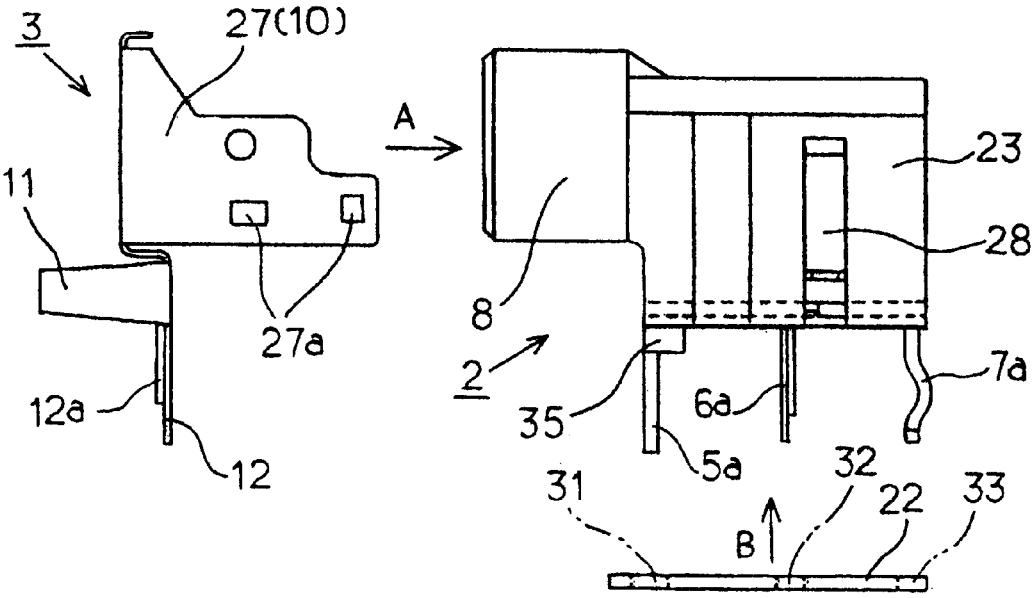
FIG. 3 is an exploded side view showing an assembly operation.
Figure 4:
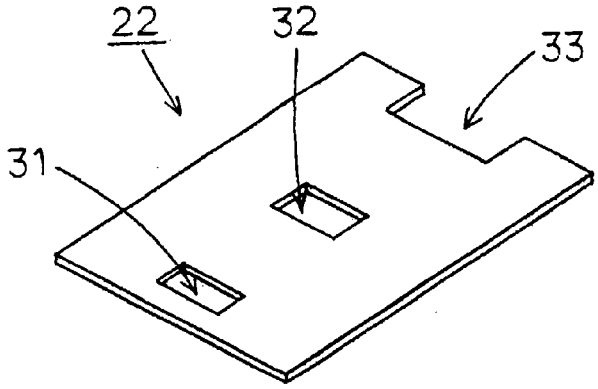
FIG. 4 is a perspective view of a shield plate.

Referring now to FIGS. 3 and 4, an assembly of shield plate 3, jack body 2 and an elastic shield plate 22 is shown. Shield plate 3 is assembled to jack body 2, bringing sleeve contact piece 12 in contact with leg portion 5*a* of sleeve terminal 5. A press contact rib 12*a* rises in a longitudinal direction on a front face portion of sleeve contact piece 12. Press contact rib 12*a* projects from a surface of sleeve contact piece 12 toward a front of shield plate 3. Sleeve contact piece 12 and leg portion 5*a* are inserted together into a terminal insertion hole 31 of elastic shield plate 22. When sleeve contact piece 12 and leg portion 5*a* are inserted into terminal insertion hole 31, press contact rib 12*a* contacts an inner wall face of terminal insertion hole 31 with a predetermined contact pressure.

Elastic shield plate 22 is formed in the shape of a rectangular plate and is capable of absorbing radio wave interference. Elastic shield plate 22 is constructed by alternately laminating a shield layer of rubber and a radio wave absorbing layer. In the radio wave absorbing layer, magnetic powder with a high magnetic flux density and other magnetic properties is dispersed in, and laminated with, a rubber material. This type of material construction is available, for example, under the trade name ABSOSHIELD manufactured by HITACHI KINZOKU Co., Ltd.

Elastic shield plate 22 is elastic and flexible, and capable of interrupting high frequency signal noise in a frequency band from about 500 MHz to 20 Ghz. Elastic shield plate 22 covers a lower face of jack body 2 which faces circuit board 4. The surface shape and size of elastic shield plate 22 is approximately the same as that of the lower face of body portion 23. Alternately, the surface shape and size of elastic shield plate 22 can be smaller than a lower face surface of body portion 23. Elastic shield plate 22 is interposed between jack body 2 and circuit board 4 and attached to the lower face of body portion 23.

Elastic shield plate 22 has a terminal insertion hole 31 with a rectangular shape, a rectangular shaped notch 32 and a rear face notch 33. Leg portion 5*a* of sleeve terminal 5 and sleeve contact piece 12 are inserted into terminal insertion hole 31. Press contact rib 12*a* contributes to the formation of a press-fit contact with an inner wall face of terminal insertion hole 31. Accordingly, shield plate 3, elastic shield plate 22 and sleeve terminal 5 contact each other with a predetermined contact pressure. In addition, shield plate 3, elastic shield plate 22 and sleeve terminal 5 are electrically connected to each other within terminal insertion hole 31.

Leg portion 6*a* of chip terminal 6 and leg portion 7*a* of ring terminal 7 are respectively inserted into notches 32 and 33 when elastic shield plate 22 is assembled to the combination of shield plate 3 and jack body 2. Notches 32 and 33 form openings which have a greater perimeter than the outer dimensions of leg portions 6*a* and 7*a*. Accordingly, insulating clearances are formed between leg portions 6*a* and 7*a*, and notches 32 and 33 of elastic shield plate 22. Thus chip terminal 6 and ring terminal 7 extend through elastic shield plate 22 without any contact therebetween.

Figure 6:
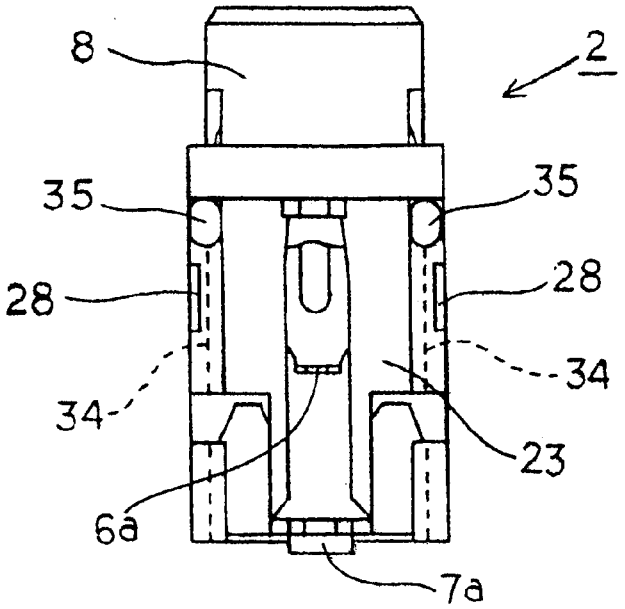
FIG. 6 is a bottom view of the jack body.

Referring now to FIGS. 5 and 6, a pair of engaging grooves 34 are formed in a longitudinal direction on the lower face of body portion 23 of jack body 2. Engaging grooves 34 permit the attachment of elastic shield plate 22 to jack body 2. Left and right hand portions of elastic shield plate 22 cooperate with engaging grooves 34 to attach elastic shield plate 22 to jack body 2. Elastic shield plate 22 is simply press-fitted to jack body 2 to permit engaging grooves 34 to attach elastic shield plate 22 to jack body 2. This arrangement permits elastic shield plate 22 to be easily detachable from jack body 2. A pair of positioning projections 35 are formed on the lower face of the jack body 2. Positioning projections 35 guide jack body 2 upon being mounted to circuit board 4.

Referring again to FIG. 3, assembly of jack 21 according to an embodiment of the present invention is shown. Assembly begins with shield plate 3 approaching jack body 2 along a direction indicated by an arrow A. As shield plate 3 extends over jack body 2, sleeve 8 of jack body 2 extends into and beyond through hole 10*a*. As assembly continues, covering portion 10 of shield plate 3 covers body portion 23 of jack body 2. Shield plate 3 is seated and attached to jack body 2 when engaging claws 26*a* and 27*a* project into engaging grooves 28. Front plate portion 25 of shield plate 3 covers the front face of jack body 2 and side plate portions 26 and 27 cover the left-hand and right-hand side faces of jack body 2, respectively. In this assembly, high frequency noise is blocked at the front face and the left-hand and right-hand side faces of jack body 2. In addition, sleeve contact piece 12 is projects downward along a front face side of leg portion 5*a* of sleeve terminal 5.

After the attachment of shield plate 3, elastic shield plate 22 approaches jack body 2 from below as shown by the direction of an arrow B. Sleeve contact piece 12 and leg portion 5a are together inserted into terminal insertion hole 31, while leg portions 6*a* and 7*a* are inserted into notches 32 and 33, respectively. Elastic shield plate 22 continues to advance toward jack body 2, and is press-fitted into engaging grooves 34 of jack body 2. Once elastic shield plate 22 is engaged with engaging grooves 34, elastic shield plate 22 is attached to the lower face of jack body 2 to form jack 21.

The above described assembly can be mounted on circuit board 4. Positioning projections 35 on jack body 2 are inserted into unillustrated concave positioning portions in circuit board 4. As shown in FIG. 1, sleeve contact piece 12, together with leg portion 5*a*, is inserted into a through hole 4*a* in circuit board 4. Leg portions 6*a* and 7*a* are also inserted into respective through holes 4*a* of circuit board 4. Jack 21 is thus arranged on, and mounted to, circuit board 4.

Leg portion 5*a* of the sleeve terminal 5 and the sleeve contact piece 12 inserted into through hole 4*a* are solder-connected to a ground pattern on a lower face of circuit board 4. Leg portion 6a of chip terminal 6 and leg portion 7*a* of ring terminal 7 are likewise solder-connected to corresponding signal patterns on the lower face of circuit board 4.

The assembly of circuit board 4 and jack 21 is arranged within the box body of a device. When circuit board 4 is positioned and fixed within the box body, sleeve 8 is inserted into sleeve insertion hole 9*a* of metallic chassis 9 as shown in FIG. 1. Pressing piece 11 of shield plate 3 contacts a rear surface of metallic chassis 9. Accordingly, metallic chassis 9, shield plate 3, elastic shield plate 22 and sleeve terminal 5 are all connected to the ground pattern of circuit board 4. All components connected to the ground pattern thus have an equal electrical potential. In this configuration, jack body 2 is reliably shielded from high frequency noise or interference, including the side of jack body 2 facing circuit board 4.

It should be understood that the present invention is not limited to the above embodiment alone, but can be adapted according to various designs. For example, elastic shield plate 22 can be attached to the lower face of jack body 2 by adhesion, removing the need for engaging grooves 34.

Shield plate 3 covers the front and side faces of the jack body 2, but may also be easily adapted to cover other surfaces, such as upper and rear faces of jack body 2. This additional coverage serves to increase the protection offered by shield plate 3 for jack body 2.

The shield plate prevents noises on left-hand and right-hand side faces of the jack body, and the elastic shield plate interrupts the incidence of high frequency noises originating from the printed wiring board. Accordingly, noise generation caused by mounting the jack to the printed wiring board can be reliably prevented.

Since the generation of noises is prevented after mounting the jack, it is not necessary to change patterns of the printed wiring board and replace jacks. Accordingly, the jack can be mounted to the printed wiring board with a simple operation to reduce lead times.

The sleeve contact piece also contacts the terminal insertion hole of elastic shield plate in a press-fit contact so that the elastic shield plate can be connected to the ground without separately arranging a grounding means.

The elastic shield plate is simply engaged with the engaging groove of the jack body to provide a simple detachable mounting on the jack body.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A jack with a shield plate mountable to a printed wiring board, comprising:

a jack body having a sleeve;

a sleeve terminal in said sleeve connectable to a ground pattern of said printed wiring board;

at least one signal terminal connectable to a signal trace of said printed wiring board;

a first shield plate attached to said jack body;

said first shield plate covers a portion of said jack body not opposed to said printed wiring board;

a second shield plate attached to said jack body;

said second shield plate being interposed between said jack body and said printed wiring board;

said second shield plate having a sleeve terminal opening and a signal terminal opening; and said sleeve terminal urged into contact with said sleeve terminal opening when said sleeve terminal is inserted thereinto; and an insulative clearance between said at least one signal terminal and said signal terminal opening when said at least one signal terminal is inserted thereinto.

2. A jack with a shield plate according to claim 1, further including:

a sleeve contact piece on said shield plate;

said sleeve contact piece elastically contacts said sleeve terminal;

said sleeve contact piece insertable into said sleeve terminal opening with said sleeve terminal; and said sleeve contact piece urged into contact with said sleeve terminal opening when said sleeve contact piece and said sleeve terminal are together inserted into said sleeve terminal opening.

3. A jack with a shield plate according to claim 1, further including:

an engaging groove on a side of said jack body opposed to said printed wiring board; and said engaging groove effective to attach said elastic shield plate.

4. A jack with a shield plate according to claim 2, further including:

an engaging groove on a side of said jack body opposed to said printed wiring board; and said engaging groove effective to attach said elastic shield plate.

5. A shielded jack mountable on a circuit board, comprising:

a jack body with an inner chamber;

a shield on said jack body;

a noise absorbent shield plate positionable adjacent said circuit board;

a common terminal accessible to said inner chamber;

a protruding portion on said common terminal;

a common terminal opening in said shield plate;

said protruding portion is urged into contact with said shield plate when said common terminal is inserted into said common terminal opening;

said shield connectable to said shield plate and said common terminal; and said circuit board having a ground circuit connectable to said common terminal.

6. A shielded jack according to claim 5, further including:

a resilient conductive member attached to said shield;

a mount body for mounting said jack; and said member resiliently contacts said mount body, thereby electrically connecting said mount body to said shield.

7. A shielded jack according to claim 5, further including:

at least one signal terminal accessible to said inner chamber;

said at least one signal terminal connectable to a signal path on said circuit board; and said at least one signal terminal insulated from said shield plate.

8. A shielded jack according to claim 5, wherein said shield plate is elastic.

9. A shielded jack with a according to claim 8, wherein said shield plate contains a magnetic powder dispersed therein.

10. A shielded jack according to claim 5, wherein:

said common terminal is adapted to connect to a common portion of a mating plug inserted into said jack; and said common terminal connected to said shield.

11. A shielded jack according to claim 5, wherein said shield plate is attached to said jack body on a surface opposed to said circuit board.

12. A shielded jack according to claim 5, further including:

a projection on said shield;

a protrusion on said projection;

an opening in said shield plate;

said protrusion contacts a wall of said opening to urge said projection into contact with said common terminal when said projection is inserted into said opening.

13. A terminal connector mountable on a circuit board, comprising:

a housing with an inner chamber;

a shield on said housing;

a noise absorbent shield plate interposed between said housing and said circuit board;

a projection on said shield;

an opening in said shield plate;

said projection being insertable through said opening and contacting said shield plate in said opening;

first and second terminals accessible to said inner chamber; and said shield connected to said shield plate and at least one of said first and second terminals.

14. A terminal connector according to claim 13, further including:

a terminal opening in said shield plate;

a protrusion on at least one of said first and second terminals; and said protrusion effective to urge said at least one of said first and second terminals into contact with said shield plate when inserted into said terminal opening.

15. A terminal connector according to claim 13, wherein at least another of said first and second terminals is electrically isolated from said shield and said shield plate.

16. A terminal connector according to claim 13, wherein said shield plate is attached to a surface of said housing opposed to said circuit board.

17. A terminal connector according to claim 13, wherein:

said projection connectable to a ground trace on said circuit board.

18. A terminal connector according to claim 13, further including:

a projection on said shield;

a protrusion on said projection;

an opening in said shield plate;

said protrusion contacts a wall of said opening to urge said projection into contact with said at least one of said first and second terminals when said projection is inserted into said opening.

19. A shielded jack for use with a wiring board, comprising:

a housing with an inner chamber;

at least a first terminal communicating with said inner chamber and an exterior of said housing;

first and second shield plates;

said first shield plate positionable adjacent a portion of said exterior of said housing not exposed to said wiring board;

said second shield plate interposeable between said housing and said wiring board;

said second shield plate being composed of a material having a magnetic powder dispersed therein; and said first and second shield plates and said at least first terminal being electrically connected and being connectable to a ground trace on said wiring board.

20. A shielded jack according to claim 19, wherein said second shield plate is elastic.

21. A shielded jack according to claim 19, further including:

an opening in said second shield plate; and said at least first terminal insertable into said opening to provide an electrical connection with said second shield plate.

22. A shielded jack according to claim 19, further including:

a projection on said first shield plate;

an opening in said second shield plate;

a wall of said opening urges said projection toward said at least first terminal when said projection is inserted through said opening thereby providing said electrical connection.

* * * * *